US009662682B2

(12) United States Patent
Perrier

(10) Patent No.: US 9,662,682 B2
(45) Date of Patent: May 30, 2017

(54) SELF-SERVE CLEANING DEVICE

(71) Applicant: Michael Joseph Perrier, Coquitlam (CA)

(72) Inventor: Michael Joseph Perrier, Coquitlam (CA)

( * ) Notice: Subject to any disclaimer, the term of this patent is extended or adjusted under 35 U.S.C. 154(b) by 146 days.

(21) Appl. No.: 14/748,234

(22) Filed: Jun. 24, 2015

(65) Prior Publication Data

US 2016/0375468 A1 Dec. 29, 2016

(51) Int. Cl.

| | |
|---|---|
| ***B08B 1/00*** | (2006.01) |
| ***B08B 1/02*** | (2006.01) |
| ***A46B 13/00*** | (2006.01) |
| ***A47L 11/00*** | (2006.01) |
| ***B08B 3/04*** | (2006.01) |
| ***D06G 1/00*** | (2006.01) |

(52) U.S. Cl.

CPC ..... *B08B 1/002* (2013.01); *A46B 13/00* (2013.01); *A47L 11/00* (2013.01); *B08B 1/02* (2013.01); *B08B 3/041* (2013.01); *D06G 1/00* (2013.01)

(58) Field of Classification Search

CPC ..... B08B 1/02; B08B 1/04; B08B 3/022

See application file for complete search history.

(56) References Cited

U.S. PATENT DOCUMENTS

| | | | | |
|---|---|---|---|---|
| 8,479,342 | B2 * | 7/2013 | Benson | B08B 1/02 134/122 R |
| 2014/0020723 | A1 | 1/2014 | Murphy | |
| 2014/0283317 | A1 * | 9/2014 | Pavan | B41F 35/02 15/103.5 |

FOREIGN PATENT DOCUMENTS

| | | | | |
|---|---|---|---|---|
| FR | 2788426 | A1 * | 7/2000 | A47L 23/24 |

* cited by examiner

*Primary Examiner* — Shay Karls

(57) ABSTRACT

Examples of self-serve cleaning device for automatically cleaning mats are disclosed. The mats can be cleaned easily and quickly within few minutes. The cleaning device comprises a compact insert washing module that comprises all of the washing and driving components that can easily and quickly be removed after a number of washing cycles and replaced with a new insert for refreshing and/or maintenance purposes.

16 Claims, 5 Drawing Sheets

SELF-SERVE CLEANING DEVICE

TECHNICAL FIELD

The present disclosure relates generally to an apparatus for cleaning flexible floor mats including exercise mats and more particularly to a self-serve unit for cleaning such mats.

BACKGROUND

Unless otherwise indicated herein, the materials described in this section are not prior art to the claims in this application and are not admitted to be prior art by inclusion in this section.

Floor mats and especially exercise mats are used on daily basis by multitude of individuals throughout the course of the day, so they become contaminated with bodily fluids containing germs, viruses, and bacteria excreted by the individuals using the exercise mats. The mats also become heavily soiled with dead skin and dirt form the floor. Current common practice in the yoga or exercise studios is to spray the mat with some strong antimicrobial chemical and wipe it with a cloth or leave the mat to air-dry. In some places the mats are simply folded and stored without cleaning. There is a need for an automated device that will easily clean the mat within a reasonable short amount of time (within few minutes).

In the known devices for cleaning floor or exercise mats, the mat is sprayed with a cleaning solution or it passes through a bath of cleaning solution, and then a set of rolling scrubbers or brushes clean the mat from one or both sides. However, none of the known cleaning devices provides a unit of scrubbers and/or brushes that are arranged in an independent compact module that could be easily replaced or refreshed after a number of cleaning cycles or for maintenance purposes. In the known cleaning devices each of the scrubbers and/or brushes are individual components so for maintenance purposes a specialized (skilled) technician needs to open the device, remove each of the individual components and assemble new individual components.

SUMMARY

In one aspect, a self-serve cleaning device for cleaning flexible mats is provided. The device comprises a housing adapted to be easily opened to access housing's inside cavity for maintenance purposes. An entrance means having an entrance opening are provided in the housing to allow a leading edge of the mat to be inserted therein. A clean mat exits through an exit opening provided in the housing. A bath tub filled with a washing solution is positioned at the bottom of the housing. The bath tub has an outlet closure connected to a drainage pipe for removing the washing solution when the outlet is opened. A compact insert module comprising plurality of driving and washing components is mounted in the housing. The insert module comprises a frame designed to support a plurality of feeding rollers arranged in a double row and positioned below the entrance to draw the mat into the housing, a plurality of brushes arranged in a double row and submerged into the washing solution to scrub each side of the mat as it passes through the bath tub, a plurality of squeezing rollers arranged in a double row and position near the exit to take a liquid out of the mat and a mat driver design to drive at least the plurality of feeding rollers and the plurality of squeezing rollers to continuously pull the mat from the entrance toward the exit.

The cleaning further comprises an ultrasonic transducer connected to a power source. The transducer is immersed into the washing solution so that it triggers vibrations in the washing solution during a cleaning process to loosen debris from the mat. The transducer is automatically triggered at the beginning of the cleaning process to vibrate for the whole duration of the cleaning process.

In another aspect, the transducer comprises a controller to control a timing of a plurality of vibrating cycles.

In yet another aspect, the insert module further comprises a washing driver supported by the frame for driving the plurality of brushes. The washing driver rotates the brushes in a direction opposite of a rotation of the feeding and squeezing rollers.

In one aspect, ultra-violet sterilization means are provided. The UV means are arranged in double row and are positioned near and below the exit to sterilize both sides of the mat.

In another aspect, the insert module further comprises a plurality of wringing rollers arranged in a double row and connected to a mat driver. The plurality of wringing rollers are positioned below the squeezing rollers and are designed to wring out the mat before entering the squeezing rollers.

In one aspect, an independent compact cleaning module for inserting into a cleaning device is provided. The module comprises a frame having a first end and a second end and is designed to support a plurality of feeding rollers arranged in a double row and positioned at the first end of the frame, a plurality of squeezing rollers arranged in a double row and position at the second end of the frame, a plurality of brushes arranged in a double row and positioned between and lower than the plurality of feeding rollers and the plurality of squeezing rollers; and a driver design to drive at least the plurality of feeding rollers and the plurality of squeezing rollers to continuously pull a cleaning subject from the first end of the module toward the second end of the module.

In addition to the aspects and embodiments described above, further aspects and embodiments will become apparent by reference to the drawings and study of the following detailed description.

BRIEF DESCRIPTION OF THE DRAWINGS

Throughout the drawings, reference numbers may be re-used to indicate correspondence between referenced elements. The drawings are provided to illustrate example embodiments described herein and are not intended to limit the scope of the disclosure. Sizes and relative positions of elements in the drawings are not necessarily drawn to scale. For example, the shapes of various elements and angles are not drawn to scale, and some of these elements are arbitrarily enlarged and positioned to improve drawing legibility.

DETAILED DESCRIPTION OF SPECIFIC EMBODIMENTS

The self-serve cleaning device of the present invention is an automated cleaning device that is designed to function primarily as a self-serve vending machine for cleaning mats that requires only a standard wall outlet to operate. The mats can be cleaned easily and quickly within a few minutes. The cleaning device comprises a unique insert washing module that comprises all of the washing and driving components, such as scrubbers, brushes and/or squeezers, and driving rollers to accomplish real functionality, reliability and serviceability. The washing module can be easily and quickly removed after a number of washing cycles and replaced with a new insert for refreshing and/or maintenance purposes.

Figure 1:
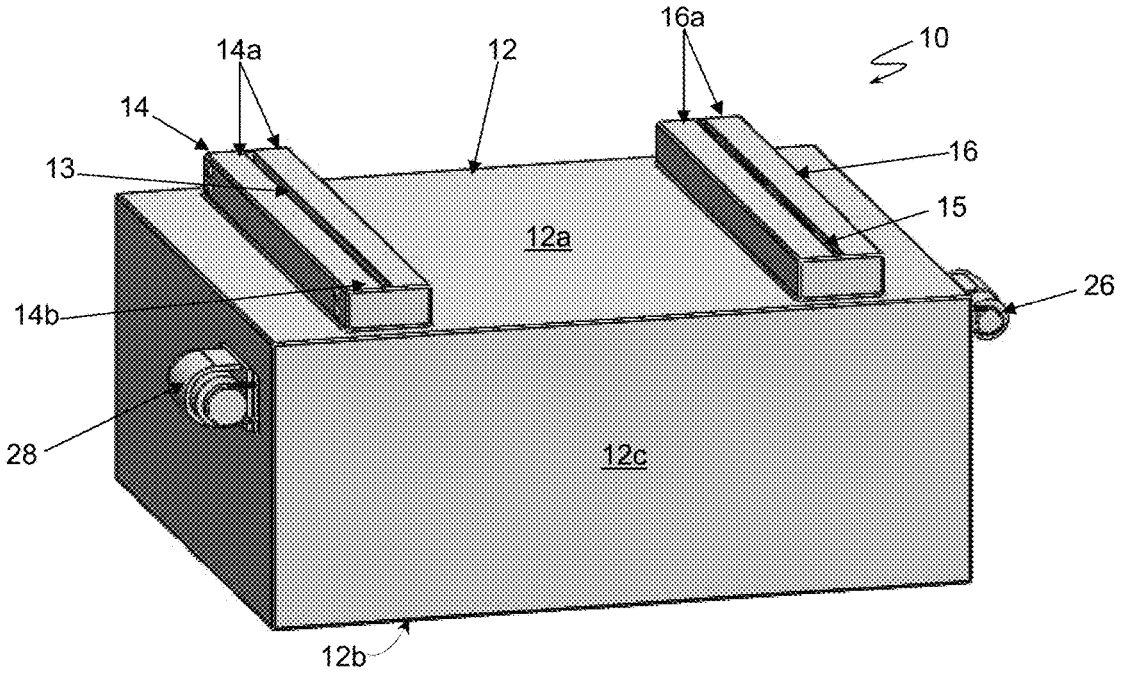
FIG. 1 is a perspective view of an example of a self-serve cleaning device showing an entrance means and an exit means.

FIG. 1 shows an example of a self-serve cleaning device 10 having a housing 12 with an entrance means 14 and an exit means 16. The housing can have a rectangular shape sized so that an ordinary sized exercise or yoga mat can pass through the housing. For example, the housing can be approximately 8 to 20 inches in height, 30 to 50 inches width and 20 to 40 inches in depth. This is for illustrational purposes only and person skilled in the art would understand that the housing 12 can have any other dimensions and/or suitable shape. For example the housing can have a cylindrical shape. The housing 12 can be made of a metal or plastic or any other suitable material or combination thereof. In the illustrated example, the housing comprises a top wall, such as a lid 12*a*, a bottom 12*b* and four sidewalls 12*c*. The lid 12*a* is designed so that it can be easily opened to access inside the housing. For example, the lid 12*a* can be attached to a top end of at least one of the side walls with hinges, clamps or screws or any other snapping/fastening means that will allow the lid to be opened or come out for maintenance purposes. In one implementation, the inside of the housing can be accessed by opening one of the side walls 12*c*. The entrance means 14 and the exit means 16 are formed in the housing 12. In the illustrated example the entrance 14 and the exit 16 are formed in the lid 12*a*. The entrance means 14 comprises an entrance opening 13 that can be defined by a pair of guiding plates 14*a*. The guiding plates 14*a* can guide and help to align the mat at the entrance. The opening 13 can be sized so that a short side of a mat can be inserted into the opening 13. The exit means 16 comprises an exit opening 15 through which a cleaned mat exits the device 10. A pair of guiding plates 16*a* can also be provided for guiding the mat at the exit. The dirty mat is fed through the entrance opening 13 and exits clean via the exit opening 15. In one implementation, a hanger (not shown) can be provided to hang the rolled dirty mat and pull the leading edge into the entrance opening 13. The hanger can be a rigid tube/pipe that is adapted so that a rolled mat can be hanged therein. The hanger ca be integrated with the housing 12 or it can be a separate component.

The bottom of the housing comprises an opening 11 (see FIG. 3) connected to a drainage pipe for draining the washing solution. FIG. 1 further shows a mat driver 26 to move the mat through the device 10. A washing driver 28 can be provided to drive washing components. In one implementation the drive motor 26 can comprise a motor and an endless belt for driving at least some of the driving components. The washing components are driven via a separate drive motor 28 for troubleshooting scenarios in case when the mat may be jammed and the mat drive motor needs to be reversed but the washing components may stay off.

Figure 2:
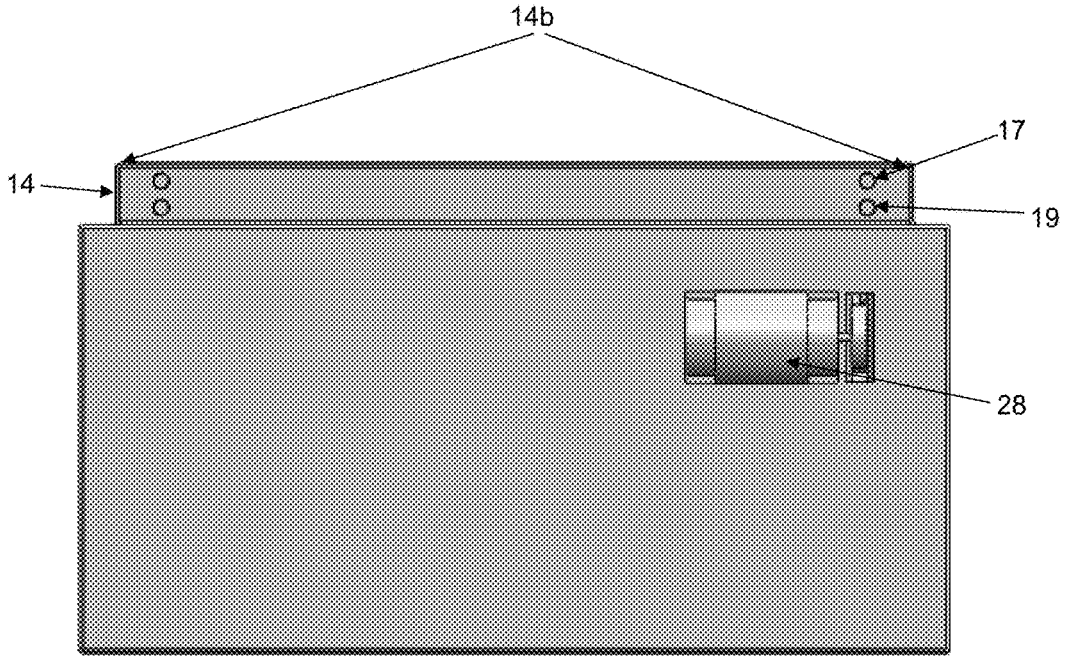
FIG. 2 is a side view showing the entrance means with a guide and alignment sensors.

The entrance means 14 further comprises an alignment means for mat alignment. For example, the entrance means can comprise a number of protrusions on each of its longitudinal ends 14*b* to help with the mat alignment. For example, there may be four circular protrusions (not shown), two on each on the ends 14*b* (one circular protrusion per guiding plates 14*a* at each end 14*b*). In addition, two or more sensors can be mounted into the entrance means to ensure that the mat that is fed into the device 10 is properly aligned. FIG. 2 shows a pair of sensors 17 positioned at each end 14*b* of the guiding plates 14*a*. The leading edge of the mat has to trigger simultaneously the sensors on each end 14*b* of the entrance 14 so that the driver 26 starts moving the driving components, such as driving rollers. For example the sensors 17 can be in communication with a limit switch (not shown) and can send a signal to such limit switch to start the driver 26. In one implementation, another set of sensors 19 can be positioned slightly lower than the sensors 17 to further guarantee the mat's alignment. The sensors 17 and/or 19 can be any kind of optical, mechanical or electronic position sensors without departing from the scope of the invention. For example, the sensors 17, 19 could be employed via a break beam laser with an emitter and a collector or a proximity sensor or limit switches.

Figure 3:
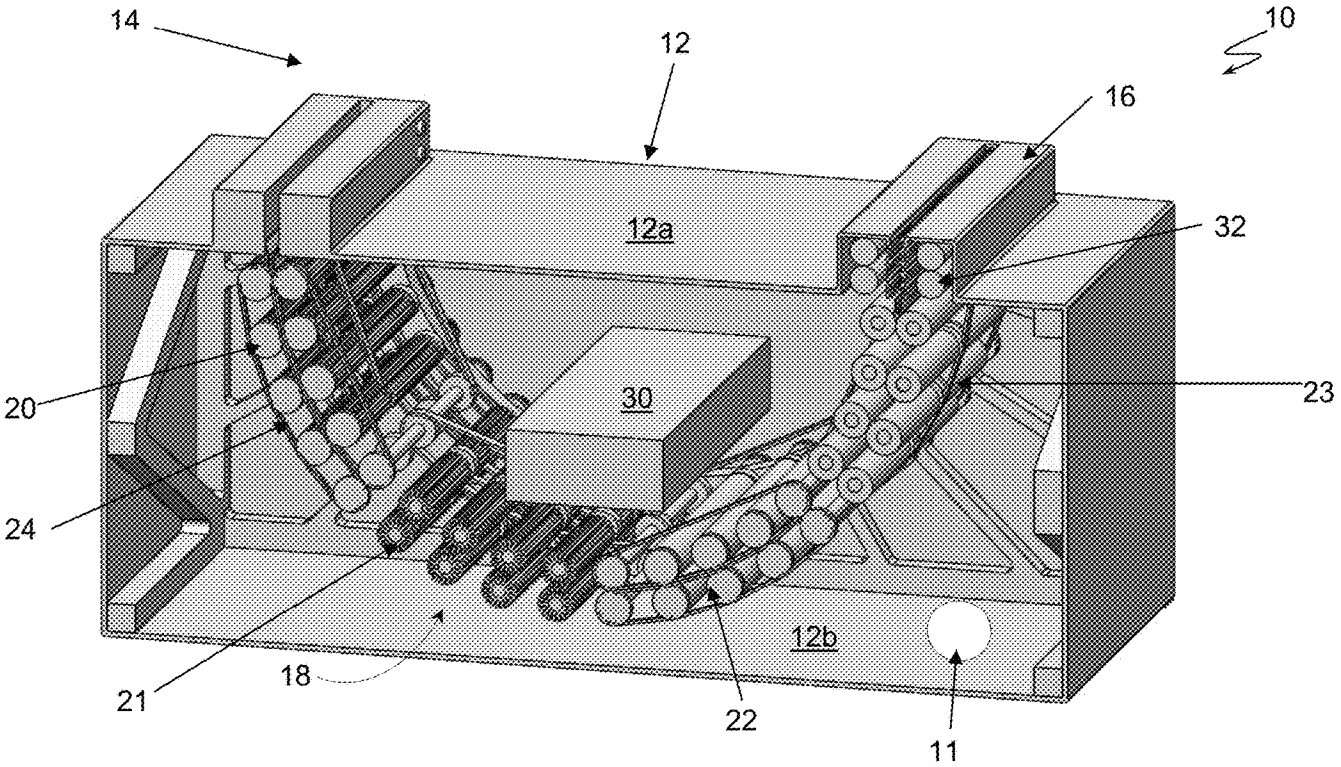
FIG. 3 is a cross-sectional view of the self-serve cleaning device showing an insert module mounted in the housing.

FIG. 3 shows in detail a compact insert module 18 that comprises driving and washing components. The insert module can comprise a plurality of top and bottom feeding rollers 20, a plurality of top and bottom brushes 21, a plurality of top and bottom wringing rollers 22, plurality of top and bottom squeezers 23 and two sets of staggered belts 24 connected to the respective drivers 26 and 28. The feeding rollers 20, wringing rollers 22 and the squeezers 23 are driven by the drive motor 26 so that the mat is continuously pulled through the device 10 while keeping it under constant tension. The washing brushes 21 are driven by the washing motor 28 and they are counter rotating with respect to the direction of the mat traveling through the device 10 for better scrubbing performance to ensure that the whole surface of the mat is cleaned while continuously drawing the mat through the device 10. The driving force of the motor 26 is bigger than the force of the motor 28 to overcome the resistance of the brushes counter-rotating and ensure forward moving of the mat toward the exit 16. In one embodiment the washing motor 28 can provide simultaneous rotating and slight linear movement of the brushes to achieve cleaning of the entire surface of the mat. The bristles of the brushes 21 are flexible to accommodate a wide range of mat thicknesses. In one implementation, the washing driver can be omitted and the brushes can be driven by the mat driver 26. In yet another implementation the brushes 21 can be stationary. The bristles of the brushes can be oriented in a direction opposite of the direction of the mat movement to achieve better scrubbing performance. The wringing rollers 22 are positioned below the squeezers 23 and are designed to provide slightly less tension (bigger space between the double rollers) to squeeze (wring out) to remove some of the washing solution out of the mat before it enters the squeezing rollers 23 which are more closely arranged to remove all of the residual liquid. In one implementation of device 10, the space between a double set of squeezing rollers decreases gradually so that the set of double rollers closest to the brushes are spaced the most (acting more as a wringing rollers) while the set of double squeezing rollers near the exit 16 are spaced the least. The rollers 20, 22 and 23 are firm yet deformable to accommodate varying mat thicknesses.

The device 10 further comprises a bath tub (not shown for clarity) to hold the washing solution. The bath tub is sized so that it can fit at the bottom 12*b* of the housing 12. It can have shape that can be same or different than the shape of the housing 12 as long as it is sized and shaped to be accommodated within the housing 12. The tub comprises an outlet closure that is aligned with the drainage opening 11 at the bottom 12*b* so that when a replacement of the washing solution is required the outlet closure is opened to remove the washing solution from the bath tub and then replace it with a fresh one. The amount of the washing solution into the bath tub can be such to provide that the brushes 21 are submerged into the washing solution while the wringing/squeezing rollers 22/23 are out of the solution. When the mat enters into the washing solution it can be thoroughly scrubbed with the brushes. The washing solution can be water or a water solution of cleaning and/or antimicrobial substance or any combination thereof.

The cleaning device 10 can further comprise an ultrasonic transducer 30 that is immersed into the water solution contained in the bath tub (not shown). The ultrasonic transducer 30 produces ultrasonic vibrations that can be applied automatically on a regular and intermittent basis to cause streaming and stirring of the washing solution to loosen the debris and dirty of the mat. The ultrasonic vibrations also create a germicidal action further sanitizing the mat. The transducer 30 can be attached to the housing, such as for example the inner side of one of the side walls 12*c*. Person skilled in the art would understand that the transducer 30 can be attached to the inner side of the lid 12*a* or the inner side of the bottom 12*b* as long as the transducer 30 is immersed in the water solution without departing from the scope of the invention. In one implementation, the transducer 30 can be attached to the frame 40 (see FIG. 4) of the insert module 18 and adapted so that when the insert 18 is mounted in the housing 12 it is immersed in the water solution contained in the tub. The transducer 30 is connected to a power source to trigger the vibrations either automatically on a regular basis for the whole duration of the cleaning process or only on intermittent basis, for example every 10 s for a duration of 5 s. For example, the transducer 30 can further comprise a controller that can be pre-programmed to trigger the power source to the pre-set vibration cycles. In one implementation the controller can be omitted and the power source is triggered by the limit switch that triggers the driver 26. FIG. 3 further shows an additional UV sterilization means 32 positioned at the exit means 16 for additionally sanitizing the mat. The sterilization means 32 can be a plurality of UV tubes or UV lamps position in a double row to sanitize both sides of the mat.

Figure 4:
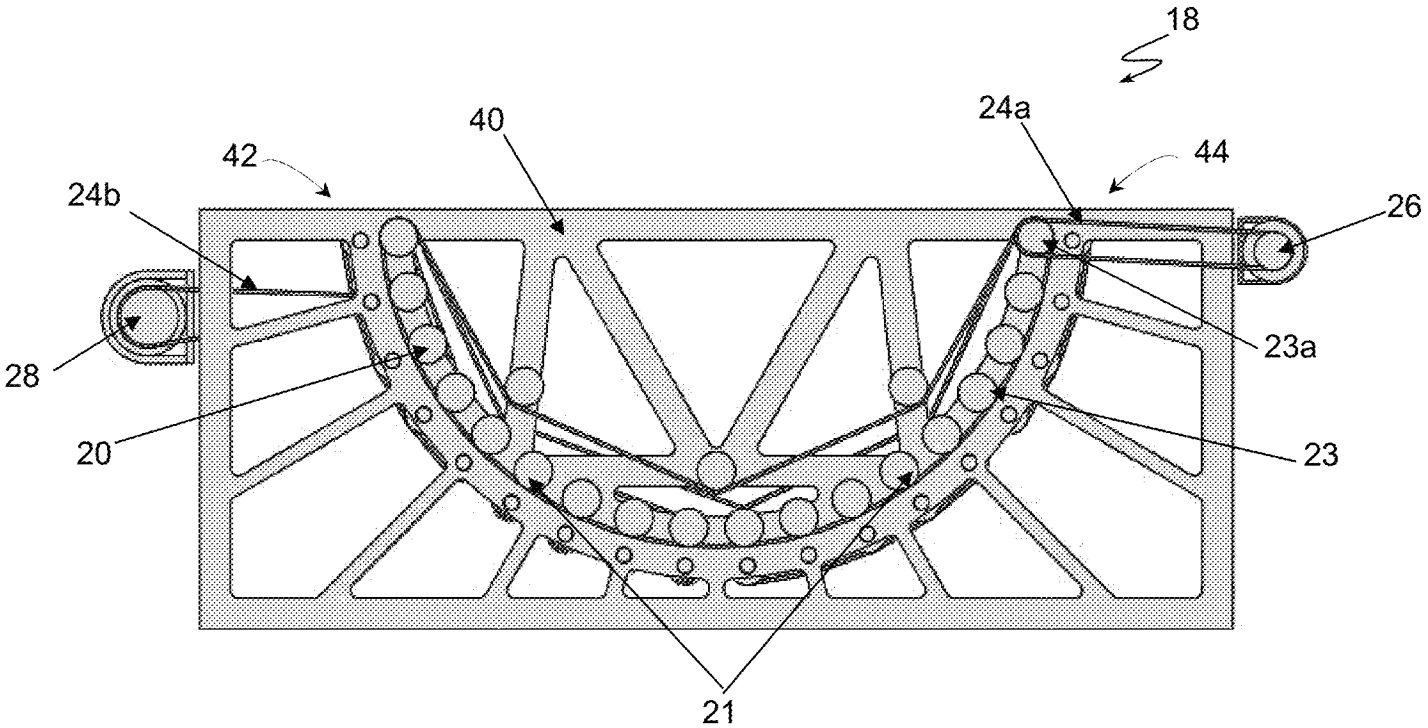
FIG. 4 is a cross-sectional side view of an example of an insert module.

The insert module 18 is mounted in the housing using a plurality of guide, slots and/or fasteners that secure the insert within the housing 12 but allow easy and quick removal out of it for replacement. FIG. 4 shows in details the insert module 18. The insert module comprises a frame 40 that is sized and shaped to be inserted into the housing 12 of the cleaning device 10. The frame 40 can be made of a rigid material suitable to support the driving and washing components of the device 10. It can be made of a metal or rigid plastic or any other suitable material or combination of materials. The frame 40 has a first end 42 and a second end 44. When the insert module 18 is mounted into the housing 12 of the cleaning device 10 the first end 42 of the insert module 18 is positioned below the entrance means 14 while the second end 44 is positioned below the exit means 16. The compact insert module 18 shown in FIG. 4 depicts an example of insert module 18 in which there are only squeezing rollers 23 where the space between the sets of double rollers gradually decreases toward the last set of rollers 23*a* closest to the exit 16 of the housing 12 (no separate wringers rollers 22 are provided). The frame 40 supports the feeding rollers 20 positioned below the entrance 14, then the plurality of brushes 21 that are positioned lower than the feeding rollers 21 and the squeezers 23 so that they are submerged into the bath tub when the insert module 18 is mounted in the housing. The squeezing rollers 23 are positioned below the exit 16. In the illustrated example of the module 18 shown in FIG. 4 only the top row of corresponding double set rollers 20, 21 and 23 are shown while the bottom row of rollers is hidden by the frame 40. The driver 26 can comprise a motor and an endless staggered belt 24*a*. The brush driver 28 comprises a motor and an endless staggered belt 14*b*. The top row of rollers 20 and 23 are driven by the motor/belt force 26/24*a* while the top row of the brushes 21 are driven the motor 28 and belt 24*b*. However, the bottom row of rollers 20 and 23, and the bottom row of the brushes 21 are driven via corresponding meshing gear set. The compact insert module 18 is designed so that it can easily be removed from the housing 12 and replaced by a new one.

Figure 5A:
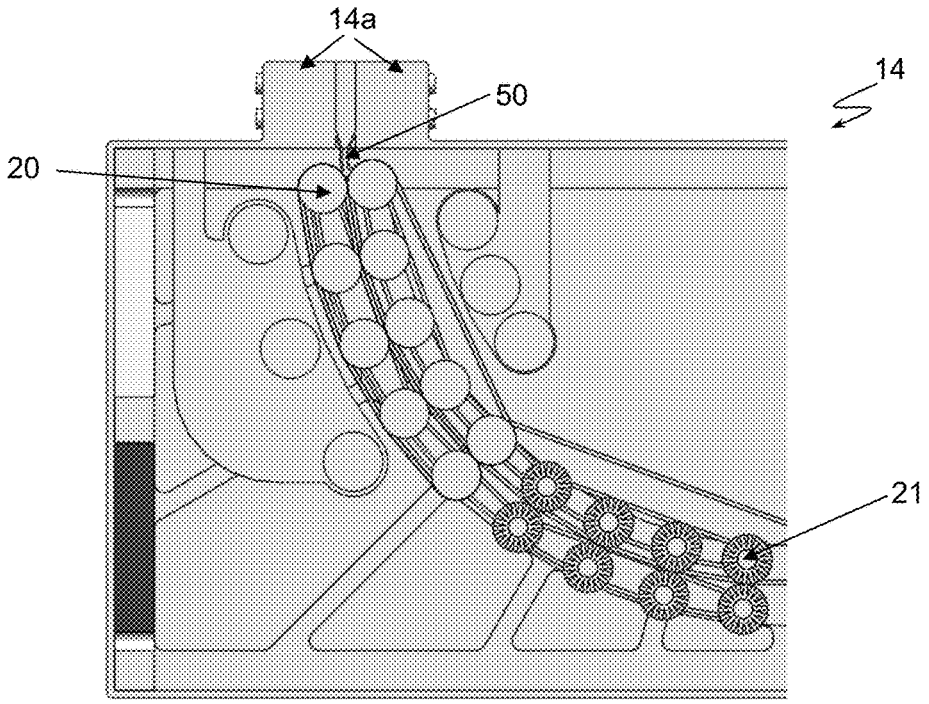
FIG. 5A is a cross-sectional partial view of a cleaning device showing an entrance means with a set of guide plates to ensure proper alignment of the mat into feeding rollers.
Figure 5B:
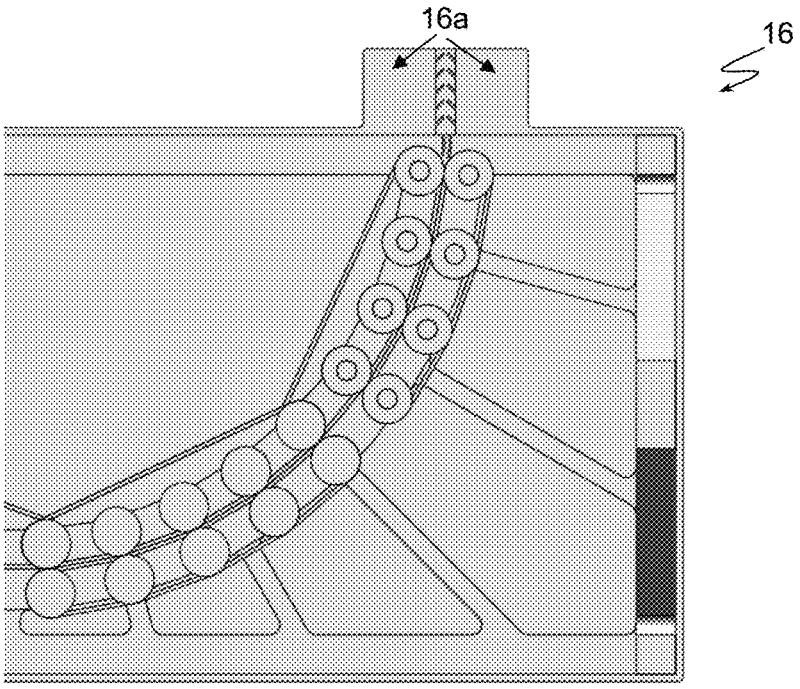
FIG. 5B is a cross-sectional partial view of a cleaning device showing an exit means with a set of guide tracks to ensure proper alignment of the mat as it exits the cleaning device.

FIG. 5A shows a cross-sectional view of the entrance means of the device 10 showing the guide plates 14*a* just above the top feeding roller forming a "v" shape 50 which ensure proper alignment of the mat into the feeding rollers 20 and the brushes 21. FIG. 5B shows the exit means 16 with the guiding plate's 16*a* ensuring proper alignment of the mat as it exits the device 10.

While particular elements, embodiments and applications of the present disclosure have been shown and described, it will be understood, that the scope of the disclosure is not limited thereto, since modifications can be made without departing from the scope of the present disclosure, particularly in light of the foregoing teachings. Thus, for example, in any method or process disclosed herein, the acts or operations making up the method/process may be performed in any suitable sequence and are not necessarily limited to any particular disclosed sequence. Elements and components can be configured or arranged differently, combined, and/or eliminated in various embodiments. The various features and processes described above may be used independently of one another, or may be combined in various ways. All possible combinations and sub-combinations are intended to fall within the scope of this disclosure. Reference throughout this disclosure to "some embodiments," "an embodiment," or the like, means that a particular feature, structure, step, process, or characteristic described in connection with the embodiment is included in at least one embodiment. Thus, appearances of the phrases "in some embodiments," "in an embodiment," or the like, throughout this disclosure are not necessarily all referring to the same embodiment and may refer to one or more of the same or different embodiments. Indeed, the novel methods and systems described herein may be embodied in a variety of other forms; furthermore, various omissions, additions, substitutions, equivalents, rearrangements, and changes in the form of the embodiments described herein may be made without departing from the spirit of the inventions described herein.

Various aspects and advantages of the embodiments have been described where appropriate. It is to be understood that not necessarily all such aspects or advantages may be achieved in accordance with any particular embodiment.

Thus, for example, it should be recognized that the various embodiments may be carried out in a manner that achieves or optimizes one advantage or group of advantages as taught herein without necessarily achieving other aspects or advantages as may be taught or suggested herein.

Conditional language used herein, such as, among others, "can," "could," "might," "may," "e.g.," and the like, unless specifically stated otherwise, or otherwise understood within the context as used, is generally intended to convey that certain embodiments include, while other embodiments do not include, certain features, elements and/or steps. Thus, such conditional language is not generally intended to imply that features, elements and/or steps are in any way required for one or more embodiments or that one or more embodiments necessarily include logic for deciding, with or without operator input or prompting, whether these features, elements and/or steps are included or are to be performed in any particular embodiment. No single feature or group of features is required for or indispensable to any particular embodiment. The terms "comprising," "including," "having," and the like are synonymous and are used inclusively, in an open-ended fashion, and do not exclude additional elements, features, acts, operations, and so forth. Also, the term "or" is used in its inclusive sense (and not in its exclusive sense) so that when used, for example, to connect a list of elements, the term "or" means one, some, or all of the elements in the list.

Conjunctive language such as the phrase "at least one of X, Y and Z," unless specifically stated otherwise, is otherwise understood with the context as used in general to convey that an item, term, etc. may be either X, Y or Z. Thus, such conjunctive language is not generally intended to imply that certain embodiments require at least one of X, at least one of Y and at least one of Z to each be present.

The example calculations, simulations, results, graphs, values, and parameters of the embodiments described herein are intended to illustrate and not to limit the disclosed embodiments. Other embodiments can be configured and/or operated differently than the illustrative examples described herein. Indeed, the novel methods and apparatus described herein may be embodied in a variety of other forms; furthermore, various omissions, substitutions and changes in the form of the methods and systems described herein may be made without departing from the spirit of the inventions disclosed herein.

What is claimed is:

1. A self-serve cleaning device for cleaning mats, the device comprising:

a housing having a top wall, a bottom wall and at least one side wall, the housing being adapted such that it can be easily opened to access its inside cavity;

an entrance means with an entrance opening formed in the housing, the entrance opening being sized so that a leading edge of a mat is inserted therein;

an exit means having an exit opening formed in the housing through which a clean mat exits;

a bath tub position in the inner cavity of the housing and filled with a washing solution, the bath tub having an outlet closure connected to a drainage pipe for removing the washing solution when the outlet is opened; and a compact insert module mounted in the housing comprising:

a frame designed to support:

a plurality of feeding rollers arranged in a double row and positioned below the entrance to draw the mat into the housing;

a plurality of brushes arranged in a double row and submerged into the washing solution to scrub each side of the mat as it passes through the bath tub;

a plurality of squeezing rollers arranged in a double row and position near the exit to take a liquid out of the mat; and a mat driver design to drive at least the plurality of feeding rollers and the plurality of squeezing rollers to continuously pull the mat from the entrance toward the exit.

2. The device of claim 1, further comprising an ultrasonic transducer connected to a power source, the transducer being immersed into the washing solution to trigger vibrations in the washing solution during a cleaning process to loosen debris from the mat.

3. The device of claim 2, wherein the transducer is automatically triggered at the beginning of the cleaning process and is vibrating for the whole duration of the cleaning process.

4. The device of claim 2, wherein the transducer further comprises a controller to control a timing of a plurality of vibrating cycles.

5. The device of claim 2, wherein the transducer is connected and integral with the insert module.

6. The device of claim 1, wherein the mat driver comprises a motor and an endless belt.

7. The device of claim 6, wherein the mat driver further comprises a meshed gear set connected with the endless belt to drive at least the feeding and the squeezing rollers.

8. The device of claim 1, wherein the mat driver is further in communication with the plurality of brushes to rotate them along with the feeding and the squeezing rollers.

9. The device of claim 1, wherein the plurality of brushes are stationary, brush bristles being orientated in a direction opposite to a moving direction of the mat.

10. The device of claim 1, wherein the insert module further comprises a washing driver supported by the frame for driving the plurality of brushes.

11. The device of claim 10, wherein the washing driver rotates the brushes in a direction opposite of a rotation of the feeding and squeezing rollers.

12. The device of claim 10, wherein the washing driver comprises a motor and an endless belt connected to the plurality of brushes.

13. The device of claim 1, further comprising ultra-violet (UV) sterilization means arranged in double row and positioned near and below the exit to sterilize both sides of the mat.

14. The device of claim 13, wherein the UV sterilization means are connected to the frame of the insert module.

15. The device of claim 1, wherein the entrance means comprise an alignment means and a sensor at each longitudinal end of the entrance opening to ensure that mat is properly aligned, the sensors being in communication to a mat driver to trigger the driver once a proper alignment is achieved.

16. The device of claim 1, wherein the insert module further comprises a plurality of wringing rollers arranged in a double row and connected to a mat driver, the plurality of wringing rollers being position below the squeezing rollers and designed to wring out the mat before entering the squeezing rollers.

* * * * *